US005304462A

United States Patent [19]

Klosterboer et al.

[11] Patent Number: 5,304,462

[45] Date of Patent: Apr. 19, 1994

[54] COMPOSITION FOR AND METHOD OF CLEANING CONTINUOUS, NONREPLENISHED FILM DEVELOPERS AND REPLENISHED FILM DEVELOPERS

[75] Inventors: Donald H. Klosterboer; Jerry M. Owens, both of San Diego, Calif.

[73] Assignee: Anacomp, Inc., Poway, Calif.

[21] Appl. No.: 916,658

[22] Filed: Jul. 20, 1992

[51] Int. Cl.[5] ..... G03C 5/305; G03C 5/31

[52] U.S. Cl. ..... 430/399; 430/406; 430/488

[58] Field of Search ..... 430/399, 409, 488, 933, 430/406

[56] References Cited

U.S. PATENT DOCUMENTS

| | | | |
|---|---|---|---|
| 3,392,122 | 7/1968 | Obayashi et al. | 252/543 |
| 3,589,921 | 6/1971 | Allison et al. | 106/137 |
| 4,264,716 | 4/1981 | Vincent et al. | 430/380 |
| 4,394,440 | 7/1983 | Cappel | 430/379 |
| 4,444,871 | 4/1984 | Miyaoka et al. | 430/409 |
| 4,587,195 | 6/1986 | Ishikawa et al. | 430/139 |
| 4,863,839 | 9/1989 | Heki et al. | 430/406 |

OTHER PUBLICATIONS

Cappel et al., "Method for Reducing Spectral Sensitizing Dye Stain in Photographic Elements", Research Disclosure No. 20733, Jul., 1981.

*Primary Examiner*—Charles L. Bowers, Jr.
*Assistant Examiner*—Mark F. Huff
*Attorney, Agent, or Firm*—Dressler, Goldsmith, Shore & Milnamow, Ltd.

[57] ABSTRACT

A solution containing a water-soluble stilbene sulfonic acid derivative which is used to solubilize oily dye residues in photodeveloper solutions used to develop direct positive silver halide film without generating foam is disclosed.

6 Claims, 1 Drawing Sheet

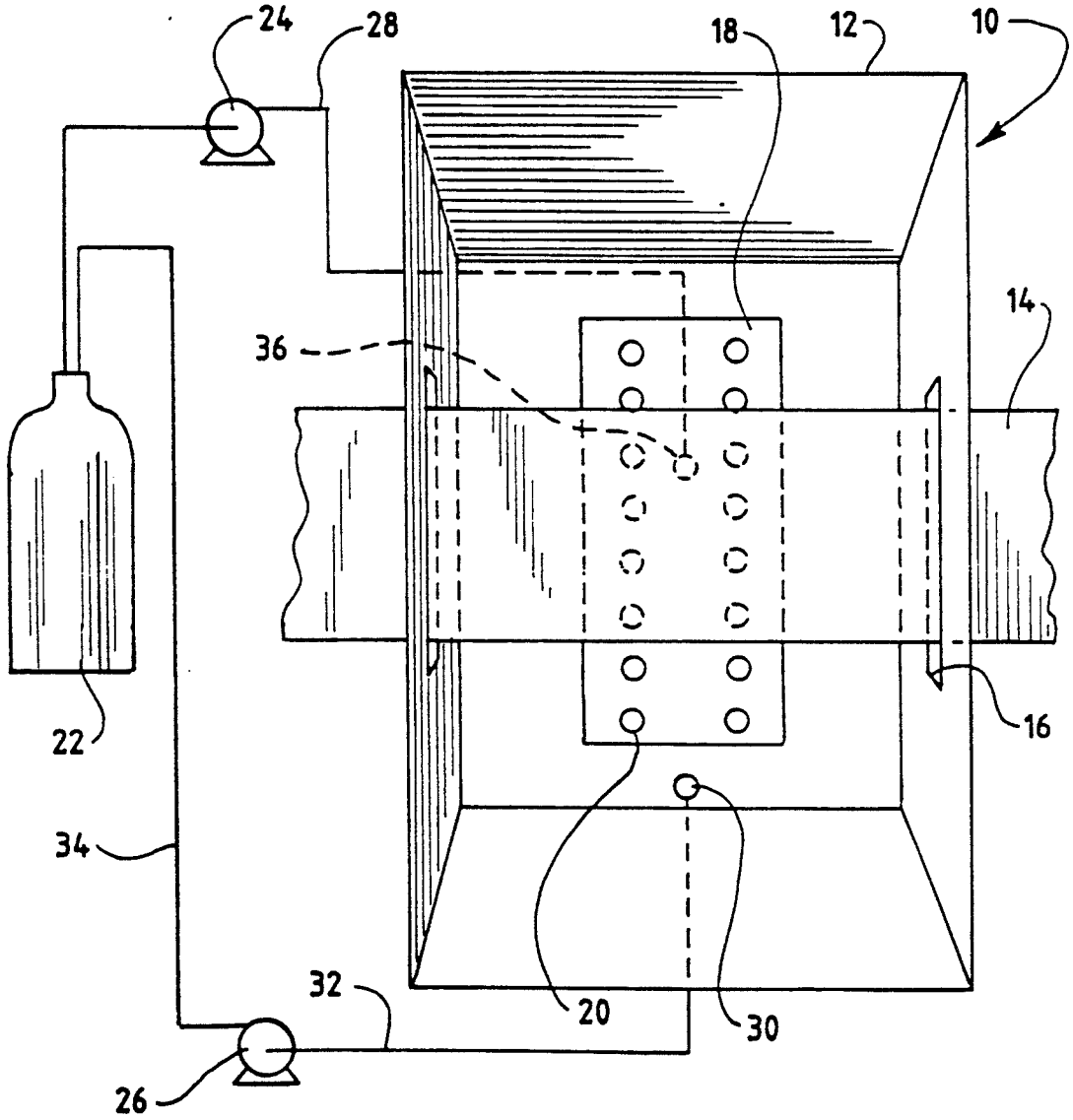
24
28
18
12
10
14
36
22
16
34
32
20
30
26

COMPOSITION FOR AND METHOD OF CLEANING CONTINUOUS, NONREPLENISHED FILM DEVELOPERS AND REPLENISHED FILM DEVELOPERS

TECHNICAL FIELD

The invention relates to a composition and a process for developing direct positive microfilm and a composition for use therein which substantially prevents oily dye residues from staining the film or the equipment used to develop the film.

BACKGROUND

In photography, an image is recorded onto film and the image on the film is then developed into a photographic reproduction of the image. Usually the film contains an emulsion on which the image is recorded. In the standard photodeveloping process, the exposed film is processed in a developer which contains primary developing agents which reduce silver in the film emulsion to produce an image thereon.

In high resolution microfilm, the film emulsion is loaded with a high level of accutance, antihalation and sensitization dyes.

When film is developed in a film processor, oily dye residues are released from the film emulsions. These oily dye residues build up over time. If these oily dye residues do not remain in solution, they will stain microfilm that is subsequently developed in the film processor or build up on the surfaces of the film processor, plugging orifices or otherwise adversely affecting the performance of the film processor.

One solution to the dye residue buildup problem is to change the developer solution in the film processor frequently. This, however, escalates the cost of photodevelopment and is not the preferred alternative. Furthermore, closed loop film processors are designed so that they will not have to be shut down prior to having developed a certain amount of film. Shutting down a closed loop process during a development cycle reduces the efficiency and economic advantages of the closed loop process.

Preferably, an emulsifier is used to solubilize the oily residues in the photodeveloper to prevent the oily dye residues from adhering to the film or the components of the film processor. Standard emulsifiers such as disodium mono- and didodecyl diphenyl oxide disulfide anionic emulsifier or sodium alpha olefin sulfonate foam are not suited for this purpose, especially when the photodeveloping solution is continuously circulated through the film processor. These standard emulsifiers foam excessively when subjected to the constant recirculation of the developing solution in this type of film processor. The very alkaline conditions of the photodeveloper solutions in this type of chemical environment also adversely affect the stability of many emulsifiers.

The foam generated by these standard emulsifiers in photodeveloping solutions is very undesirable. Conventional surfactants are therefore of limited usefulness for preventing the build up of oily dye residues in the chemical environment required by film development, especially in closed loop film processors.

Brightening agents have also been incorporated into photodeveloping solutions in order to control, reduce or eliminate the problem of dye stains on developed film. U.S. Pat. No. 4,264,716 to Vincent et al. incorporates brightening agents into photodeveloping compositions to reduce staining.

However, brightening agents merely cover up or correct dye stains on photographs. Brightening agents do not solubilize the oily dye residues in the developer solution to prevent them from staining the film or adhering to components of the film processing tanks.

Typical brightening agents include stilbene type brightening agents. Stilbene-containing compositions have been used to reduce or eliminate stains on film caused by the build up of oily dye residues in the developer solution.

A published disclosure, Cappel, C.R. and Purol, M.D., "Method for Reducing Spectral Sensitizing Dye Stain in Photographic Elements," *Research Disclosures,* No. 20733 (Kenneth Mason Publications, Ltd, Jul. 10, 1981) describes adding a water soluble stilbene, bis-4, 4'-s-triazyl amino stilbene sulfonic acid or mixtures of water-soluble stilbenes and nonionic surfactants, into a developing solution. The build up of dibenzooxazole carbocyanine sensitizing dyes in the gel matrix or within a coupler dispersion in the photographic emulsion layers was said to be avoided by the addition of the aqueous amino stilbene sulfonic acid solution. Dibenzooxazole carbocyanine sensitizing dyes extend the sensitivity of photographic emulsions to electromagnetic radiation which is beyond the wave lengths of visible light.

U.S. Pat. No. 4,587,195 to Ishikawa et al. discloses a method of processing a silver halide photographic light-sensitive film material. The method is said to be economical because the amount of photodeveloping solution used in the process is reduced.

In Ishikawa et al. the reduction in the amount of photodeveloping solution used is accomplished by not changing the photodeveloping solution in the film processor as often. Since the photodeveloping solution is not changed as often, the problems associated with the accumulation of oily dye residues on film processing equipment become more acute.

In Ishikawa et al., a combination of two different triazyl stilbene-type brightening agents must be added to the color developer to avoid the adverse effects caused by the build up of oily dye residues therein. The brightening agents are present in the photodeveloper in an amount of about 0.3 gram to about 10 grams per liter of color developer solution.

If the maximum fluorescent wavelengths of the fluorescent spectra of the two triazyl stilbenes used in Ishikawa et al. are less than 4 mμ apart, the triazyl stilbene solution will not remove the dye stains, however. If only one of the two types of stilbene brightening agents is used or if the difference in the maximum fluorescent wavelength of the two triazyl stilbenes is not at least 4 mμ, build up of oily dye residues in the developer solution remains a problem. If the amount of triazyl stilbene in solution exceeds 10 grams per liter, the film's development will be adversely effected and fluorescent quenching or an unfavorable photographic performance such as non-color may result.

From the foregoing it is apparent that the type of stilbene used to reduce dye stains on films is linked to the type of dye residue in the process. The type of dye residue in the process is linked to the emulsion on the film. The emulsion on the film is linked to the type of film and the process by which the film is developed.

Standard films have an emulsion thereon which is compatible with the developing process for standard films which requires bleaching steps to convert the negative image on the film to a positive photographic image. Other films, such as direct positive films, do not require bleaching steps because a positive image is recorded directly onto the film when the film is exposed to that image. Photographic emulsions are provided on direct positive films which are compatible with this type of developing process.

Thus, there continues to be a need for a composition which will solubilize the oily dye residues produced by the development of direct positive silver halide film without foaming. If the oily dye residues are sufficiently solubilized, they will remain in solution and not adhere to the film or build up on the components of the film processor.

In continuous, automatic developers where the photodeveloping solution is recirculated and not replenished until a predetermined amount of film is developed, it is important that the oily dye residues remain solubilized until the photodeveloping solution is spent. Otherwise the film processor has to be shut down more frequently to change the solution, and the economy of the continuous, nonreplenished process is adversely effected. The composition also must not adversely affect the direct positive silver halide film developing process.

SUMMARY OF THE INVENTION

A stilbene-based composition is used to solubilize dye residues in a recirculating photodeveloper solution in which direct positive silver halide film is developed. The inventive composition is especially advantageous because it achieves the desired result without foaming.

In a process for removing these dye stains, the stilbene-based composition is added to a photodeveloping solution or directly to a film processor used to develop direct positive silver halide film. The photodeveloping solution is continuously recirculated while the film is passed through it. No foam is produced when the composition is placed in contact with the photodeveloper solution or the oily dye residues associated with direct positive silver halide film.

The composition is an aqueous solution of a water-soluble stilbene sulfonic acid derivative. The solution is either water or a photodeveloper solution. The water-soluble stilbene sulfonic acid is present in the solution in an amount of about 0.3 gram to about 1 gram per gallon thereof.

The stilbene-based composition can be used to solubilize the oily yellow to greenish-brown dye residue which builds up in the film processing tanks of a photodeveloper when a direct positive silver halide film is developed therein. A particular type of direct positive film, AutoPOS 2000 TM, produces a yellow oily residue when developed using a suitable photodeveloping solution such as an AutoPOS 2000 TM CHEM Kit. AutoPOS 2000 TM film and the AutoPOS 2000 TM CHEM Kit are marketed by the assignee of the present invention. AutoPOS 2000 TM is a trademark of Anacomp, Inc. of San Diego, Calif.

The dye that produces the undesirable residue is present in the emulsion contained on the direct positive silver halide film. The inventive aqueous stilbene-based composition solubilizes the residue of this dye. The solubilized dye residues remain in solution and do not stain the film as readily, nor do they as readily adhere to the stainless steel components of the processing tanks of the film processor.

In an alternate embodiment the stilbene-based composition is added to a film processor wherein the photodeveloper solution is replenished. In the replenished film processor, the photodeveloper solution is periodically added to or replenished. In this alternate embodiment, the stilbene-based composition is added to the replenished developer solution when there is a noticeable build-up of dye residues on any of the replenished film processor's components. About 0.1 gram to about 6 grams of the stilbene-based composition are added per gallon of photodeveloper solution in the replenished film processor. Preferably, about 0.5 gram to about 1.5 grams of the stilbene-based composition are added per gallon of photodeveloper solution.

The solubilized dye residues are also more readily rinsed from an empty film processor using water or a cleaning solvent such as isopropyl alcohol and the like. Using the inventive stilbene-based composition also avoids the need to use a brush or towels to remove oily dye residue that is deposited on the stainless steel parts of the film processor's tanks when direct positive silver halide film is developed therein using a suitable developing solution.

BRIEF DESCRIPTION OF THE DRAWING

FIG. 1 is a schematic view of a film processor looking down into the photodeveloping tank.

DESCRIPTION OF THE PREFERRED EMBODIMENTS

While the present invention is susceptible to embodiment in many forms, there is a presently preferred embodiment which is hereinafter described, with the understanding that the present disclosure is intended as an exemplification of the invention, and is not intended to limit the invention to the specific embodiment illustrated.

The type of film and the kind of dye affect the choice of emulsifier which will effectively control, reduce or eliminate the buildup of the oily dye residue in a photodeveloper solution. For example, direct positive silver halide film has a particular type of emulsion thereon which permits a positive image to form directly on the film to which the image is exposed.

The emulsion is preferably deposited on a polyester film base, although all standard photographic film bases such as cellulose and the like are contemplated. AutoPOS 2000 TM Silver Film is a high resolution, fast speed direct positive film manufactured by the Eastman Kodak Company for Anacomp, Inc. of Indianapolis, Ind. the assignee of the present invention.

The AutoPOS 2000 TM film is a silver halide film with a photographic grade polyester base that is about 7 mils thick. The film is manufactured according to all applicable ANSI standards, including ANSI PH1.41. The film has a dimensional stability of about ±0.2 percent in any direction and a nominal thickness of 7.2 mils before processing.

The film has a medium high contrast and an extremely fine grain. The film is a hardened emulsion for high temperature, fast access processing at temperatures up to 100° F. The film has a high accutance and is designed to produce a positive appearing microfilm of a type produced by computer driven microfilm cameras, referred to as COM systems.

The exposed positive film is suitable for use as a master for Diazo Duplication, a copying process for making useable copies of images stored on nonarchival film.

The developed AutoPOS 2000 TM film is of archival quality which can be used for permanent records.

AutoPOS 2000 TM film is designed to meet or exceed all ANSI, IRS and DOD requirements for archival storage according to ANSI PH2.33-1983 and PH2.40-1985. AutoPOS 2000 TM film has a special sensitivity which responds to type P228CRT phosphor and forms overlay exposures made with a cold cathode, blue light source.

AutoPOS 2000 TM film is developed using an AutoPOS 2000 TM CHEM Kit which is commercially available from the Multiprodux Division of Anacomp, which is also located in Indianapolis, Ind. The AutoPOS 2000 TM CHEM Kit contains pre-mixed, ready to use photographic chemicals to develop the film, fix the image thereon and wash the film in an automatic, continuous film processor.

The pH of the photodeveloping solution in the AutoPOS 2000 TM CHEM Kit is about 11. The AutoPOS 2000 TM CHEM Kit is formulated to process 1000 master microfiche and can be used for up to 40 hours in a film processor. A master microfiche, simply referred to as a fiche, is a 4 inch by 6 inch film with various micro images thereon. The AutoPOS 2000 TM CHEM Kit produces an archival quality master microfiche with a background density in excess of 1.8 and a character density of 0.06 under proper exposure conditions.

Darkroom facilities are not necessary to develop AutoPOS 2000 TM film using the AutoPOS 2000 TM CHEM Kit if the film is used in a COM Recorder. The AutoPOS 2000 TM film is delivered in prepackaged cassettes which are then loaded directly into the automatic film processor which contains the AutoPOS 2000 TM CHEM Kit under normal lighting conditions.

AutoPOS 2000 TM film is developed in a constant volume, automatic process in which the photodeveloper solution is recirculated using the AutoPOS 2000 TM CHEM kit. When developing AutoPOS 2000 TM film using the AutoPOS 2000 TM CHEM Kit, a particular dye residue builds up in the photodeveloper solution.

AutoPOS 2000 TM film can also be developed in a replenished film processor. The difference between a replenished film processor and a closed loop, nonreplenished film processor is that the replenished film processor is not a closed loop, i.e., developing solution is added to the film processor periodically. When AutoPOS 2000 TM film is developed in a replenished film processor, the same dye residue that builds up in the constant volume photodeveloper solution builds up in the replenished photodeveloper solution.

If the yellow to greenish-brown oily dye residue begins to stain film developed in the film processor it will have to be shut down and cleaned, and the photodeveloper solution will have to be changed before it is spent. The economy, efficiency and speed of the process is reduced by these early shutdowns. Therefore, it is important for the oily dye solution to remain solubilized in the photodeveloper solution to optimize the speed and efficiency of developing AutoPOS 2000 TM film using the AutoPOS 2000 TM CHEM kit.

FIG. 1 is a schematic representation of a continuous, constant volume, nonreplenished film processor 10 wherein the photodeveloper solution is recirculated. The film processor has a tank 12. Other conventional components of the film processor unrelated to the present invention are not shown.

Film 14 is fed into the photoprocessing tank 12 through an aperture 16. The mechanism for feeding the film into the film processing tank 12 is not shown. The film 14 passes between stainless steel plate 18 and a top plate (not shown). Stainless steel plate 18 has a plurality of openings 20 therein. The top stainless steel plate (not shown) is solid.

The photodeveloping fluid is supplied from a photodeveloping fluid reservoir 22. An inlet pump 24 is provided to pump the photodeveloping solution from the reservoir, through an inlet line 28 and entry port 36 in the tank 12. The entry port 36 is located beneath the plate 18. The photodeveloping fluid passes through the openings 20 in the plate 18 and contacts the film 14.

The photodeveloping solution is returned to the fluid reservoir through the outlet 30 in the tank 12. The photodeveloping solution is pumped through outlet line 32 by outlet pump 26 and through return line 34 back to the reservoir 22 for reuse. If the oily dye residue from the photodeveloping process does not remain solubilized in the solution, it will build up on the plate 18 and in severe cases, will plug up the holes 20, impeding or preventing the photodeveloping solution from contacting the film 14, which obviously adversely affects the film processor's efficiency and the quality of the film developed therein.

Standard emulsifiers were tested and found to be unsuitable for preventing the yellow to greenish-brown oily dye residue from building up on or staining the components of film processors or the film developed therein. Any emulsifier which has a tendency to foam when subjected to agitation is not suitable for use in a continuous, recirculating process where the photodeveloping solution is in constant motion.

A disodium mono- and didodecyl diphenyl oxide disulfonate anionic emulsifier, which is stable in both acidic and alkaline environments and has good thermal stability, emulsified the oily dye residue which was formed when AutoPOS 2000 TM film was developed. That emulsifier foamed a great deal and was therefore unsatisfactory.

A similar problem was encountered when a spray dried biodegradable sodium alpha olefin sulfonate, commercially available as Bio Terge AS-90 Beads from the Stepan Chemical Co. in Northfield, Ill., was used to emulsify the oily dye residue formed when AutoPOS 2000 TM film was developed. This alpha olefin sulfonate also foamed excessively when used in the alkaline photodeveloping solution.

In order to significantly reduce the build up of oily dye residue that results when AutoPOS 2000 TM film is developed, an aqueous solution of a stilbene sulfonic acid derivative is prepared and either used to rinse the film processor after it has been emptied or added directly to the AutoPOS 2000 TM CHEM Kit. A typical photodeveloping solution contains alkalies to control pH, thiocyanates, bromides, chlorides, iodides, benzyl alcohol, sulfites, thickening agents, solubilizing agents, brightening agents, wetting agents, stain reducing agents and the like. The pH of the photodeveloping solution is typically greater than 11.

Although the pH of the photodeveloping solution is greater than 11, the aqueous solution of stilbene sulfonic acid does not foam when added to the photodeveloper solution, even when subjected to the agitation that results from recirculating the photodeveloper solution. As a result, it is especially effective and useful in solubilizing the oily dye residue.

The aqueous solution containing a stilbene sulfonic acid derivative is prepared by adding the stilbene sulfonic acid in an amount of about 0.2 gram to 1 gram, preferably about 0.4 gram to about 0.6 gram to one gallon of solution. The solution can either be water or a photodeveloper solution such as the solution provided by the AutoPOS 2000 TM CHEM Kit. The water-soluble stilbene sulfonic acid preferred for use herein is Blankophor BSU (also known as Phosphor BSU) which can be obtained commercially from the Mobay Corporation in Pittsburgh, Pa. Blankophor BSU belongs to the chemical class of triazinylaminostilbenes and is listed in the Color Index compiled by the American Association of Textile Chemists and Colorists of Research Triangle Park, N.C. as Color Index Fluorescent Brightener 264. Blankophor BSU is a light yellow powder having a bulk density of approximately 450 kilograms per cubic meter. It is soluble in water to the extent of about 150 grams per liter at 20° C. When 100 grams of Blankophor BSU are mixed with water, a solution having a pH of 8.0 to 9.0 is produced.

The stilbene sulfonic acid derivative can also be used to solubilize oily dye residues that result from developing AutoPOS 2000 TM film in a nonreplenished film processor. About 0.1 to about 6 grams of stilbene sulfonic acid derivative is added per gallon of photodeveloper solution. Preferably about 0.5 gram to about 1.5 grams of the stilbene sulfonic acid derivative are added to the photodeveloper solution. The stilbene sulfonic acid derivative can be added to the photodeveloper solution before it is used to develop AutoPOS 2000 TM film, or some time after the photodeveloper solution has been used to develop AutoPOS 2000 TM film. The stilbene sulfonic acid derivative solubilizes the oily dye residues produced by developing AutoPOS 2000 TM film in the photodeveloper solution.

The following examples are for the purpose of illustrating the concepts more generally discussed hereinabove and are not intended as limitations of the more general concepts that are disclosed and claimed herein.

EXAMPLE 1

Solubilizing Oily Dye Residues In A Film Processor Using An Aqueous Solution Containing A Stilbene Sulfonic Acid Derivative An aqueous cleaning solution was prepared by combining 0.9 grams of Blankophor BSU, a stilbene sulfonic acid derivative, with one gallon of water. The cleaning solution was then added to a film processor which had been used to develop AutoPOS 2000 TM film using an AutoPOS 2000 TM CHEM Kit obtained from Anacomp, Inc. of Indianapolis, Ind. The film processor contained a great deal of dark greenish-brown residue. Most of the residue was loosened by the cleaning solution within 15 minutes after it was added to the empty film processor.

The film processor was then rinsed. A small amount of dye residue was left on some of the stainless steel portions of the processor. The remaining dye residue was easily removed using isopropyl alcohol. If the cleaning solution had not been used in the processor, great effort would have been required to remove these stains using a conventional solvent such as isopropyl alcohol.

EXAMPLE 2

Solubilizing Oily Dye Residues In A Film Processor Containing An AutoPOS 2000 TM CHEM Kit Using An Aqueous Solution 0f Stilbene Sulfonic Acid Derivative Cleaning solutions for each of two film processors were prepared by combining two 0.9 gram measures of Blankophor BSU, a stilbene sulfonic acid derivative, each with one-half gallon of photodeveloper solution suitable for developing AutoPOS 2000 TM film. The photodeveloper solution was added to a closed loop, continuous, recirculating film processors. AutoPOS 2000 TM film was then developed therein.

Over 1000 fiche of film were processed over a three day period, after which the film processor was emptied and inspected. There was no oily sludge in the bottom of the film processor fix supply basin. Although there was a small amount of yellow dye residue on the stainless steel portions of the film processor, this was a noticeable improvement over the amount of oily dye residue which would normally build up in the processor when a similar amount of AutoPOS 2000 TM film was developed using the AutoPOS 2000 TM CHEM Kit without the Blankophor BSU incorporated therein.

EXAMPLE 3

Solubilizing Oily Dye Residues In A Replenished Film Processor Using A Stilbene Sulfonic Acid Derivative Approximately 0.9 gram of Blankophor BSU, a stilbene sulfonic acid derivative, was added to approximately one gallon of a photodeveloper solution that had been used for approximately 3 weeks prior to the addition of the Blankophor BSU. The developer solution was used to develop AutoPOS 2000 TM film. Before the Blankophor BSU was added to the solution, significant quantities of yellow dye were apparent on portions of the replenished film processor. About two days after the Blankophor BSU was added to the photodeveloper solution the film processor was almost completely free of yellow dye build up. This test was conducted several times over a seven week period. The same results were obtained with each test.

EXAMPLE 4

Solubilizing Oily Dye Residues In A Replenished Film Processor Using A Stilbene Sulfonic Acid Derivative Approximately 1 gram of Blankophor BSU, a stilbene sulfonic acid derivative, was added per gallon of photodeveloper solution. The photodeveloper solution with the Blankophor BSU therein was then added to a replenished film processor. The photodeveloper solution was used to develop AutoPOS 2000 TM film for approximately six weeks. The film processor was essentially free of any observable dye residue build up during that period.

From the foregoing, it will be observed that numerous variations and modifications may be effected without departing from the true spirit and scope of the present invention. No limitation with respect to any specific example disclosed herein should be inferred. All modifications that fall within the scope of the appended claims are intended to be covered thereby.

What is claimed is:

1. A process for solubilizing oily dye residues in a recirculating photodeveloper solution comprising combining triazinylaminostilbene with a photodeveloping solution used to develop a direct positive silver halide film to produce a substantially nonfoaming recirculating photodeveloper solution having about 0.2 gram to about 1 gram of triazinylaminostilbene per gallon of said photodeveloper solution; developing said film in said photodeveloper solution while said film releases oily yellow to greenish-brown dye residues into said photodeveloper solution; and substantially solubilizing said oily dye residues in said photodeveloper solution.

2. The process of claim 1 wherein about 0.4 gram to about 0.6 gram of triazinylaminostilbene is present per gallon of said photodeveloper solution.

3. The process of claim 1 wherein said photodeveloper solution is aqueous and comprises about 0.3 gram to about 1 gram of triazinylaminostilbene per gallon of water in said photodeveloper solution.

4. The process of claim 3 wherein about 0.4 gram to about 0.6 gram of triazinylaminostilbene is present per gallon of water in said photodeveloper solution.

5. A replenished process for developing film comprising;

combining triazinylaminostilbene capable of solubilizing an oily yellow to greenish-brown dye residue which has accumulated in a film processing tank of a photodeveloper and a photodeveloping solution to form a substantially nonfoaming aqueous photodeveloper solution having about 0.03 gram to about 1 gram of triazinylaminostilbene therein per gallon of water in said photodeveloper solution;

adding said photodeveloper solution having triazinylaminostilbene therein to a film processor suitable for developing positive silver halide film when there is a build-up of the oil residue in the film processor; and developing a substantially oily dye residue stain-free film in the film processor with said photodeveloper solution therein.

6. The process of claim 5 wherein about 0.4 gram to about 0.6 gram of triazinylaminostilbene is present per gallon of water in said photodeveloper solution.

* * * * *

UNITED STATES PATENT AND TRADEMARK OFFICE

CERTIFICATE OF CORRECTION

PATENT NO. : 5,304,462

DATED : April 19, 1994

INVENTOR(S) : Donald Klosterboer and Jerry M. Owens

It is certified that error appears in the above-indentified patent and that said Letters Patent is hereby corrected as shown below:

Column 10, line 8 delete [0.03] and insert —0.3—

Signed and Sealed this

Third Day of December, 1996

Bruce Lehman

*Attest:*

BRUCE LEHMAN

*Attesting Officer*

*Commissioner of Patents and Trademarks*